US009839305B2

(12) United States Patent
Maddux

(10) Patent No.: US 9,839,305 B2
(45) Date of Patent: Dec. 12, 2017

(54) RECONFIGURABLE DISPLAY TABLE

(71) Applicant: Daniel Maddux, San Antonio, TX (US)

(72) Inventor: Daniel Maddux, San Antonio, TX (US)

(73) Assignee: American Payroll Institute, Inc., San Antonio, TX (US)

( * ) Notice: Subject to any disclaimer, the term of this patent is extended or adjusted under 35 U.S.C. 154(b) by 0 days.

(21) Appl. No.: 13/655,367

(22) Filed: Oct. 18, 2012

(65) Prior Publication Data

US 2014/0110555 A1 Apr. 24, 2014

(51) Int. Cl.
*F16L 3/00* (2006.01)
*A47F 5/06* (2006.01)

(52) U.S. Cl.
CPC ..... *A47F 5/06* (2013.01); *Y10T 29/49826* (2015.01)

(58) Field of Classification Search
CPC ..... A47G 7/041
USPC ..... 108/151, 152, 92; 211/205; 248/159, 248/165, 188.4
See application file for complete search history.

(56) References Cited

U.S. PATENT DOCUMENTS

| | | | | | |
|---|---|---|---|---|---|
| 554,661 | A | * | 2/1896 | Doolittle | 108/105 |
| 663,838 | A | * | 12/1900 | White | 211/70 |
| 3,197,034 | A | * | 7/1965 | Deadrick | 211/205 |
| D222,276 | S | * | 10/1971 | Hughes | D30/160 |
| 3,698,564 | A | * | 10/1972 | Muller | 211/119.003 |
| 3,874,512 | A | * | 4/1975 | Wegley | A47B 81/00 211/163 |
| 5,746,334 | A | * | 5/1998 | Brandenberg | 211/205 |
| 2007/0289209 | A1 | * | 12/2007 | Hager | 47/39 |

* cited by examiner

*Primary Examiner* — Amy Sterling
(74) *Attorney, Agent, or Firm* — Greenberg Traurig LLP

(57) ABSTRACT

A table display including a support pole, one or more arm hubs, one or more arms extending from the one or more arm hubs and table tops supported by the one or more arms. The support pole may be retained by a connection node or weighted floor member. Table tops may be transparent to allow decorative arms to be viewed therethrough. A wall-mounted version comprises a bracket configured to connect to a wall unistrut, an arm hub, one or more arms extending from the arm hub and a table top supported by the one or more arms.

8 Claims, 21 Drawing Sheets

RECONFIGURABLE DISPLAY TABLE

FIELD OF THE INVENTION

The embodiments of the present invention relate to a display table reconfigurable to accommodate varying needs of a user.

BACKGROUND

Convention centers and similar meeting facilities are designed with quick and easy modification in mind. That is, such facilities need to accommodate different groups, products and shows in relatively short spans of time so that they are designed to allow for quick and easy changes to the layout and appearance of the facility.

It would be advantageous to develop a reconfigurable display table providing versatility allowing a display table to be reconfigured readily and easily.

SUMMARY

One embodiment of the present invention comprises a support pole, one or more arm hubs, one or more arms extending from said one or more arm hubs and table tops supported by said one or more arms. In one embodiment, the support pole is retained by a connection node of the type disclosed in co-pending application Ser. No. 13/304,076, filed on Nov. 23, 2011, which is incorporated herein by reference for all purposes. In one embodiment, three to five arms extend from the one or more arm hubs. In one embodiment, the table tops are transparent to allow decorative arms to be viewed therethrough.

Another embodiment of the present invention comprises a bracket configured to connect to a wall unistrut, an arm hub, one or more arms extending from said arm hub and a table top supported by said one or more arms.

Another embodiment of the present invention involves expandable arms configured to receive and support arm branches.

The embodiments of the present invention provide a table display capable of easy re-configuration and versatility including both standalone and wall-mounted embodiments.

Other variations, embodiments and features of the present invention will become evident from the following detailed description, drawings and claims.

DETAILED DESCRIPTION

Figure 1A:
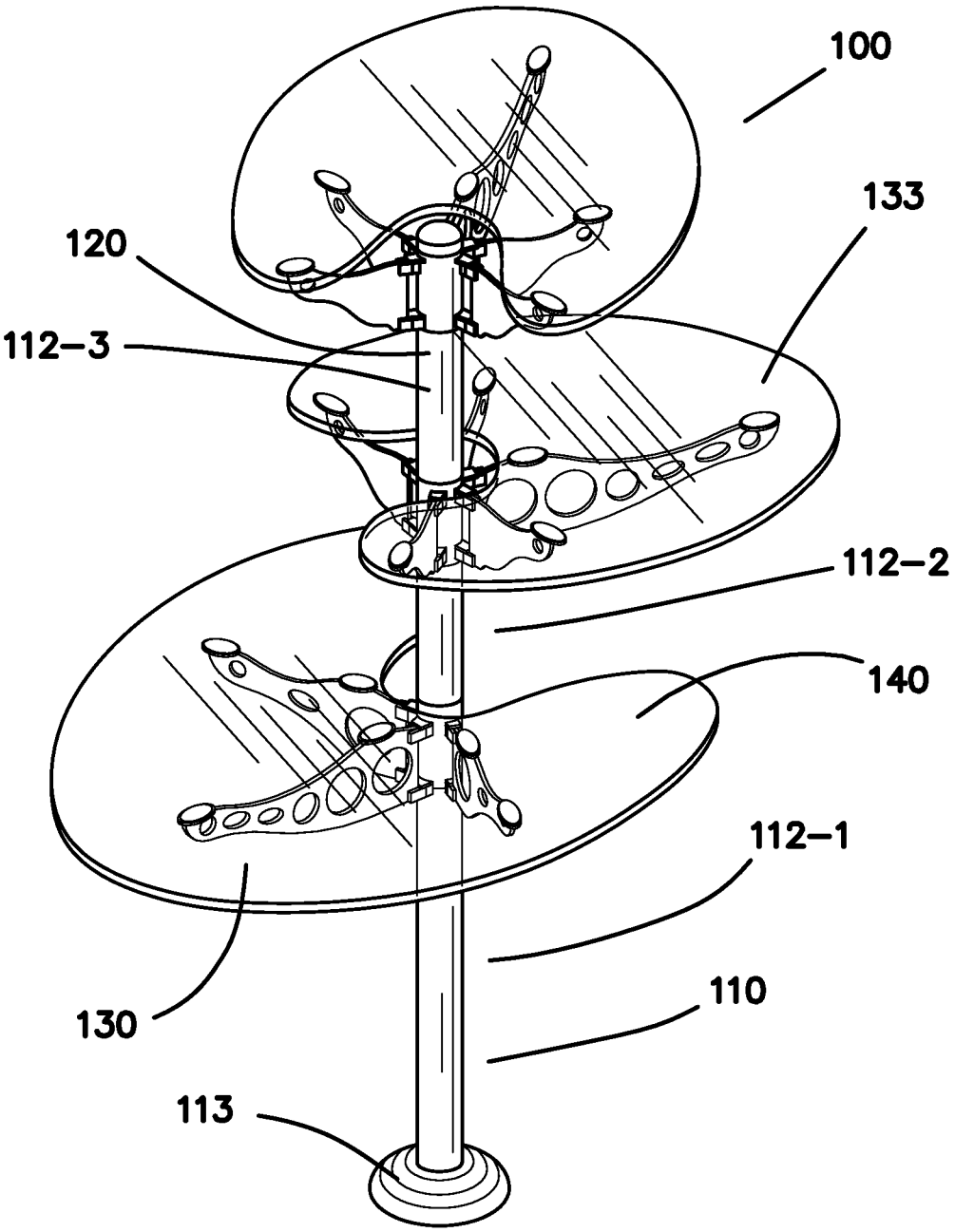
FIGS. 1A-1B illustrate upper perspective and side views of a standalone display table according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the embodiments of the present invention may be fabricated of any suitable materials, including, but not limited to, plastics, alloys, composites, resins and metals, and may be fabricated using suitable techniques, including, but not limited to, molding, machining and rapid prototyping.

Figure 1B:
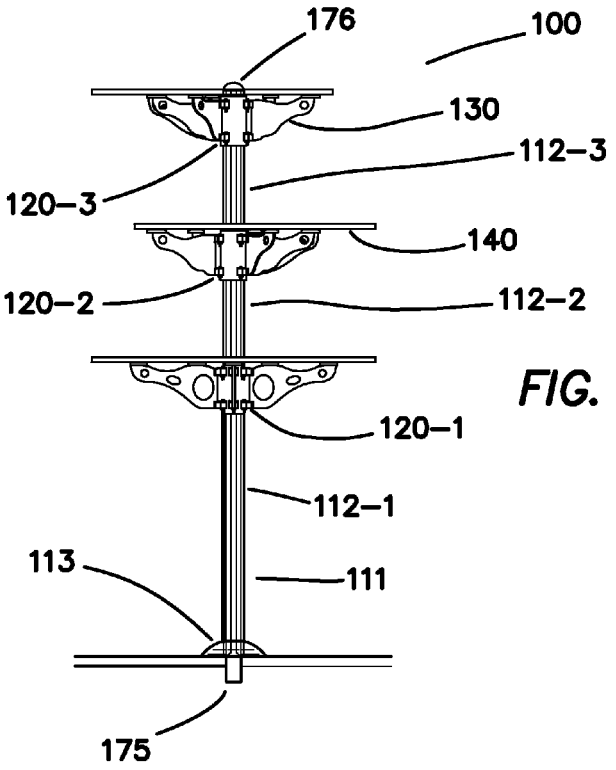

FIGS. 1A and 1B show upper perspective and side views of a standalone display table 100 according to the embodiments of the present invention. The display table 100 comprises a support pole 110, one or more arm hubs 120, one or more arms 130 extending from said one or more arm hubs 120 and table tops 140 supported by said one or more arms 130.

Figure 3A:
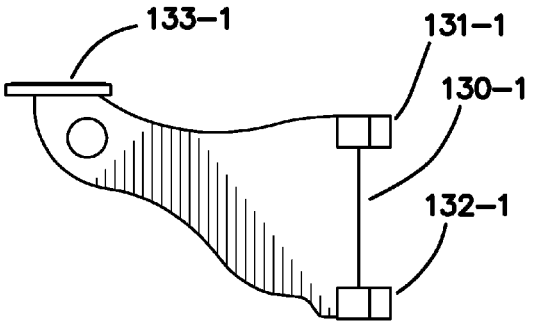
FIGS. 3A-3B illustrate side and top views, respectively, of a first arm according to the embodiments of the present invention.
Figure 3B:
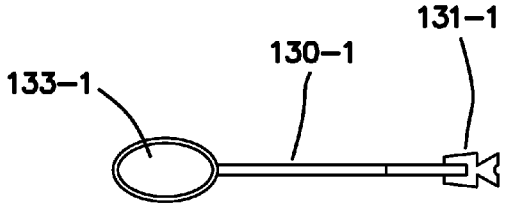
Figure 4A:
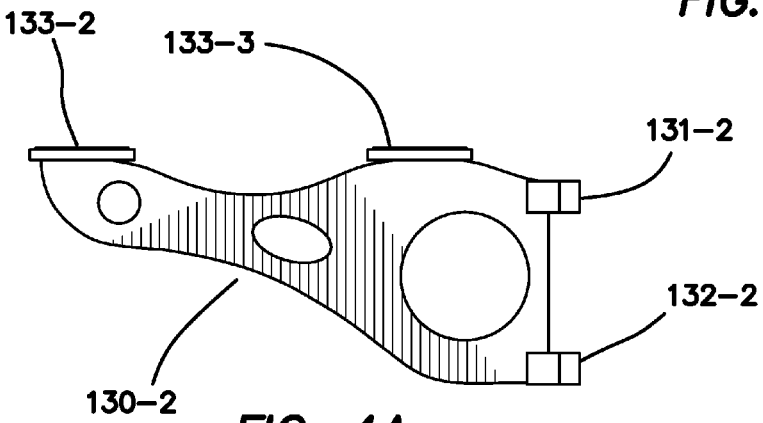
FIGS. 4A-4B illustrate side and top views, respectively, of a second arm according to the embodiments of the present invention.
Figure 4B:
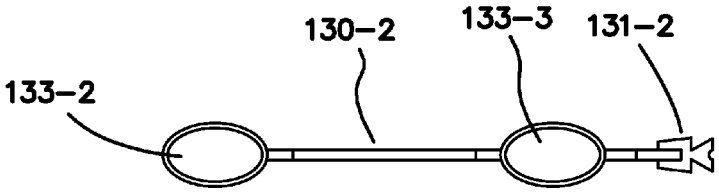
Figure 5A:
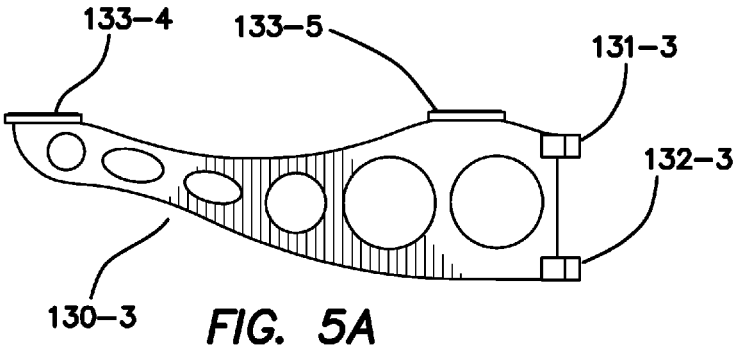
FIGS. 5A-5B illustrate side and top views, respectively, of a third arm according to the embodiments of the present invention.
Figure 5B:
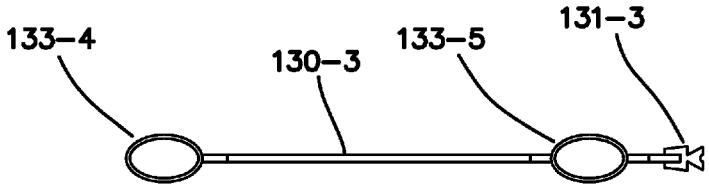
Figure 6A:
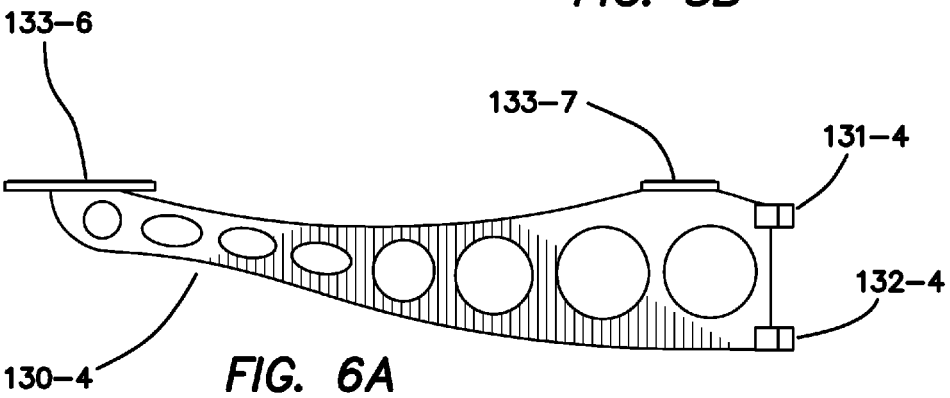
FIGS. 6A-6B illustrate side and top views, respectively, of a fourth arm according to the embodiments of the present invention.
Figure 6B:
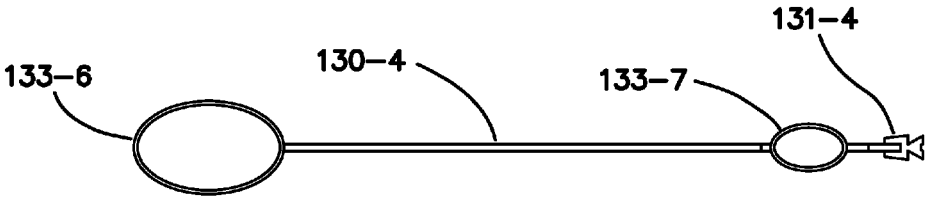
Figure 7A:
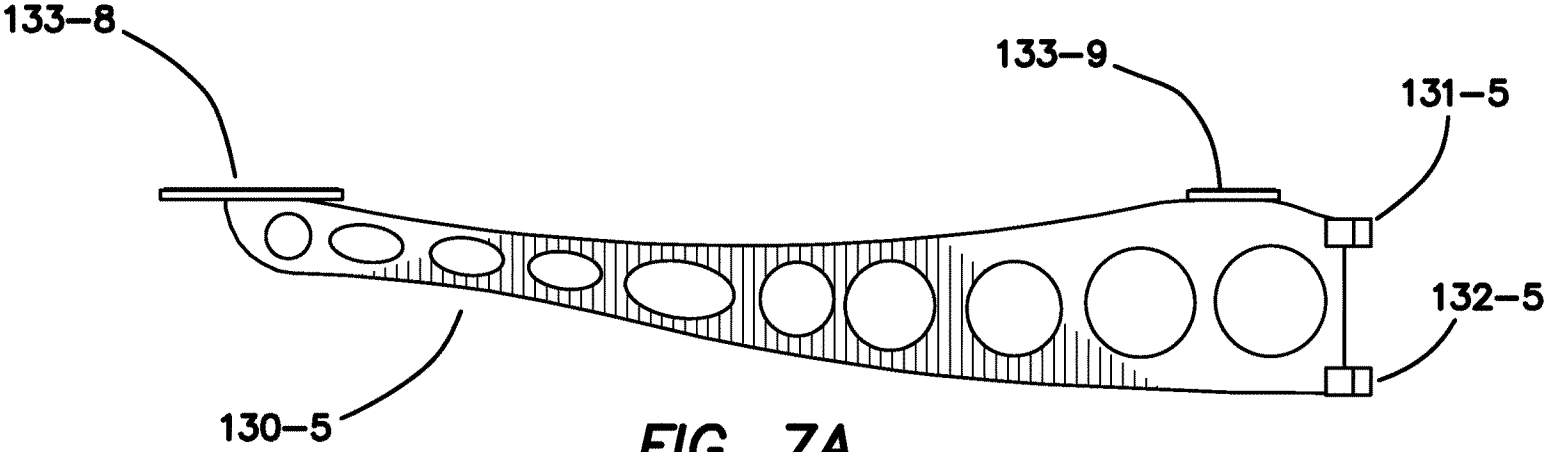
FIGS. 7A-7B illustrate side and top views, respectively, of a fifth arm according to the embodiments of the present invention.
Figure 7B:
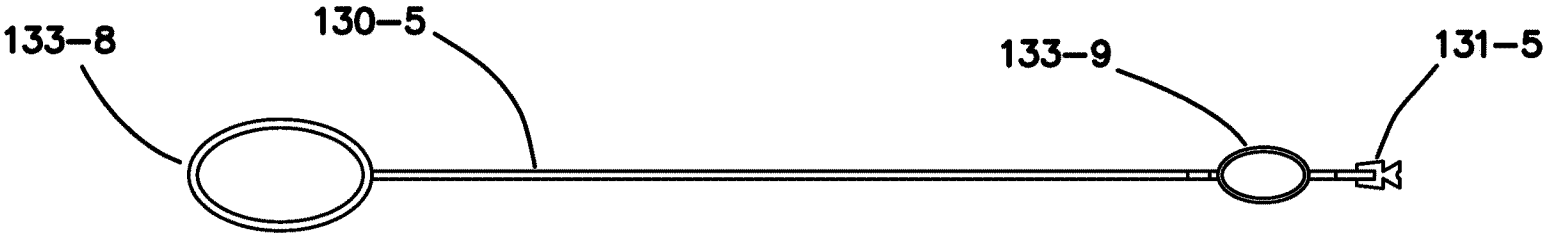

FIGS. 3A-3B show a first arm 130-1 comprising an upper connector 131-1 and lower connector 132-1 at one end thereof and a shelf 133-1 proximate a second end thereof. As shown in FIG. 1A, the shelf 133, which may be padded, is configured to support a table platform 140. FIGS. 4A-4B show a second arm 130-2 comprising an upper connector 131-2 and lower connector 132-2 at one end thereof and a first shelf 133-2 proximate a second end thereof and a second shelf 133-3 proximate the upper connector 131-2. FIGS. 5A-5B show a third arm 130-3 comprising an upper connector 131-3 and lower connector 132-3 at one end thereof and a first shelf 133-4 proximate a second end thereof and a second shelf 133-5 proximate the upper connector 131-3. FIGS. 6A-6B show a fourth arm 130-4 comprising an upper connector 131-4 and lower connector 132-4 at one end thereof and a first shelf 133-6 proximate a second end thereof and a second shelf 133-7 proximate the upper connector 131-4. FIGS. 7A-7B show a fifth arm 130-5 comprising an upper connector 131-5 and lower connector 132-5 at one end thereof and a first shelf 133-8 proximate a second end thereof and a second shelf 133-9 proximate the upper connector 131-5. The upper connectors 131-1 through 131-5 and lower connectors 132-1 through 132-5 are configured to attach to the collars 120 which rotate about the support pole 110. In one embodiment, nuts 111 and bolts 112 serve to attach the arms 130-1 through 130-5 to the arm hubs 120. Other connecting devices, such as rivets and screws, may be used as well.

The arms 130-1 through 130-5 are shown with abstract shapes and decorative openings 135 along lengths thereof. Those skilled in the art will recognize that the arms 130-1 through 130-5 are exemplary only and other arm designs are conceivable within the spirit and scope of the present invention.

Figure 8A:
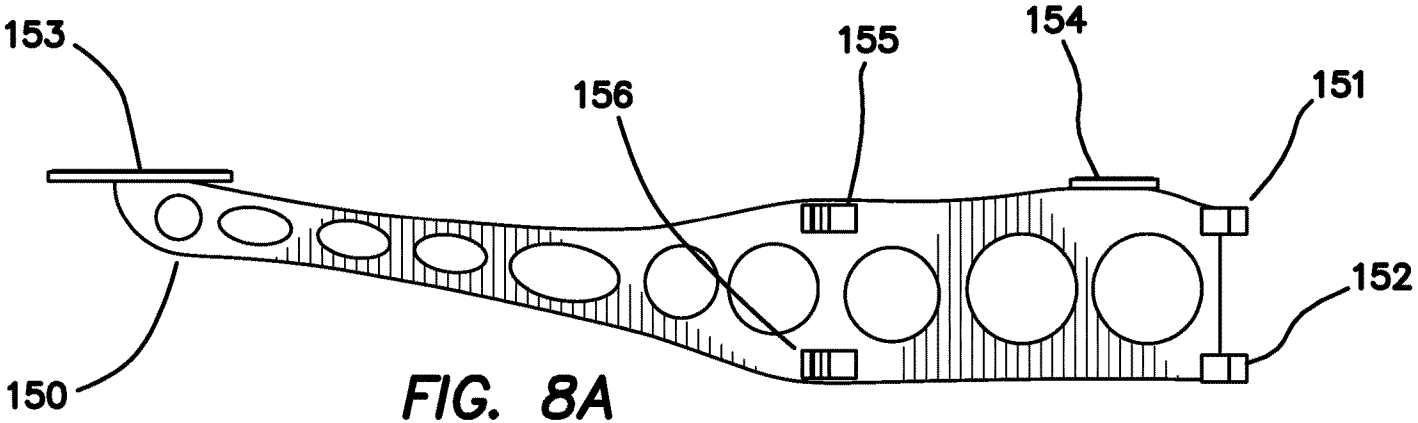
FIGS. 8A-8B illustrate side and top views, respectively, of an expandable arm according to the embodiments of the present invention.
Figure 8B:
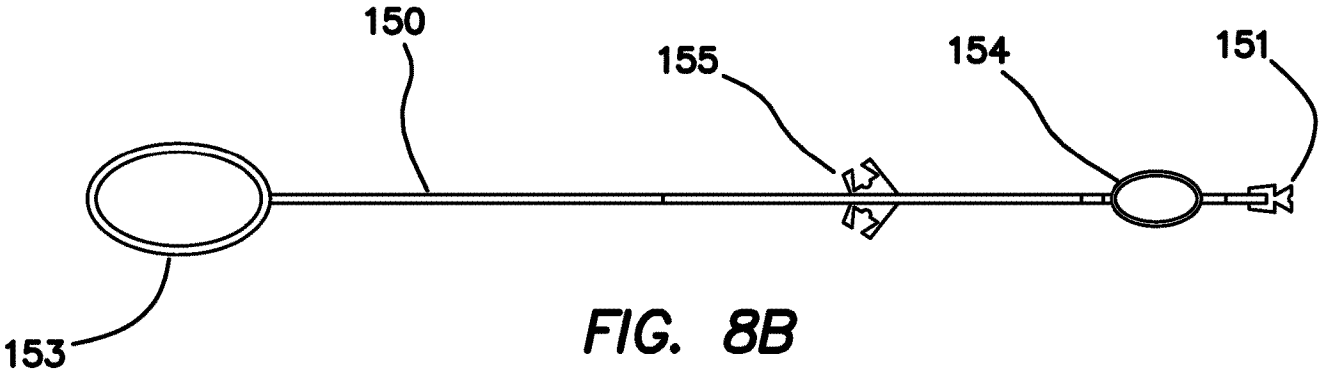
Figure 9A:
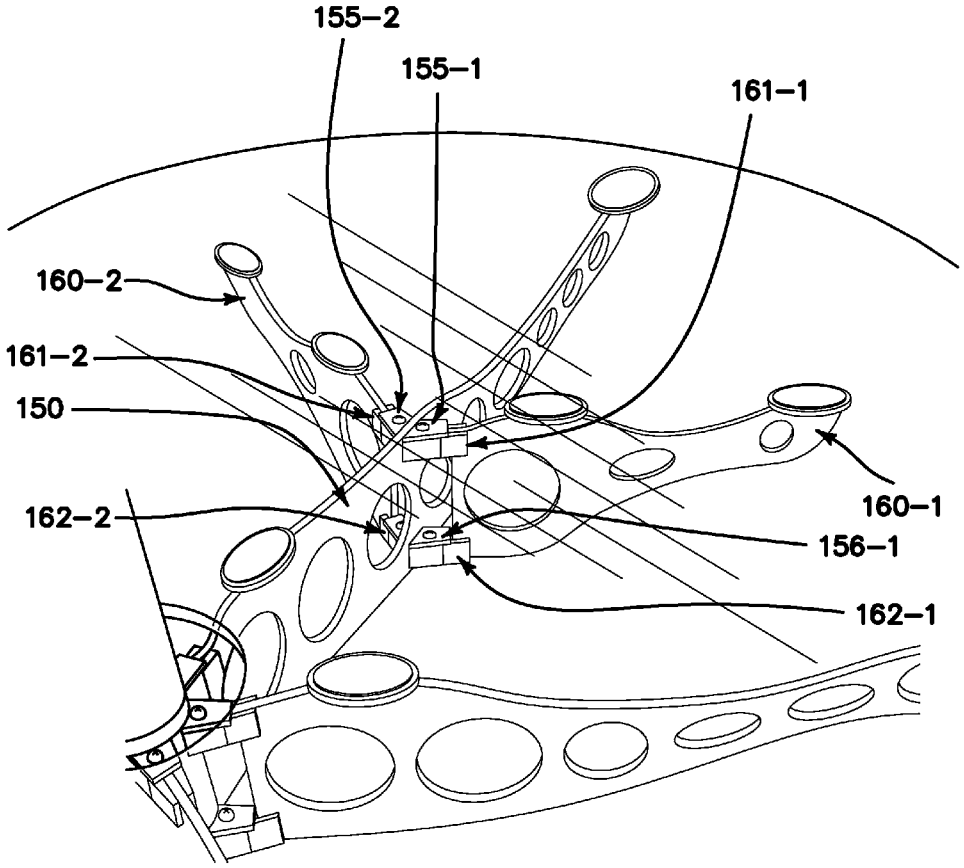
FIGS. 9A-9B illustrate a perspective top view of the expandable arm of FIGS. 8A-8B with multiple arm branches attached according to the embodiments of the present invention.
Figure 9B:
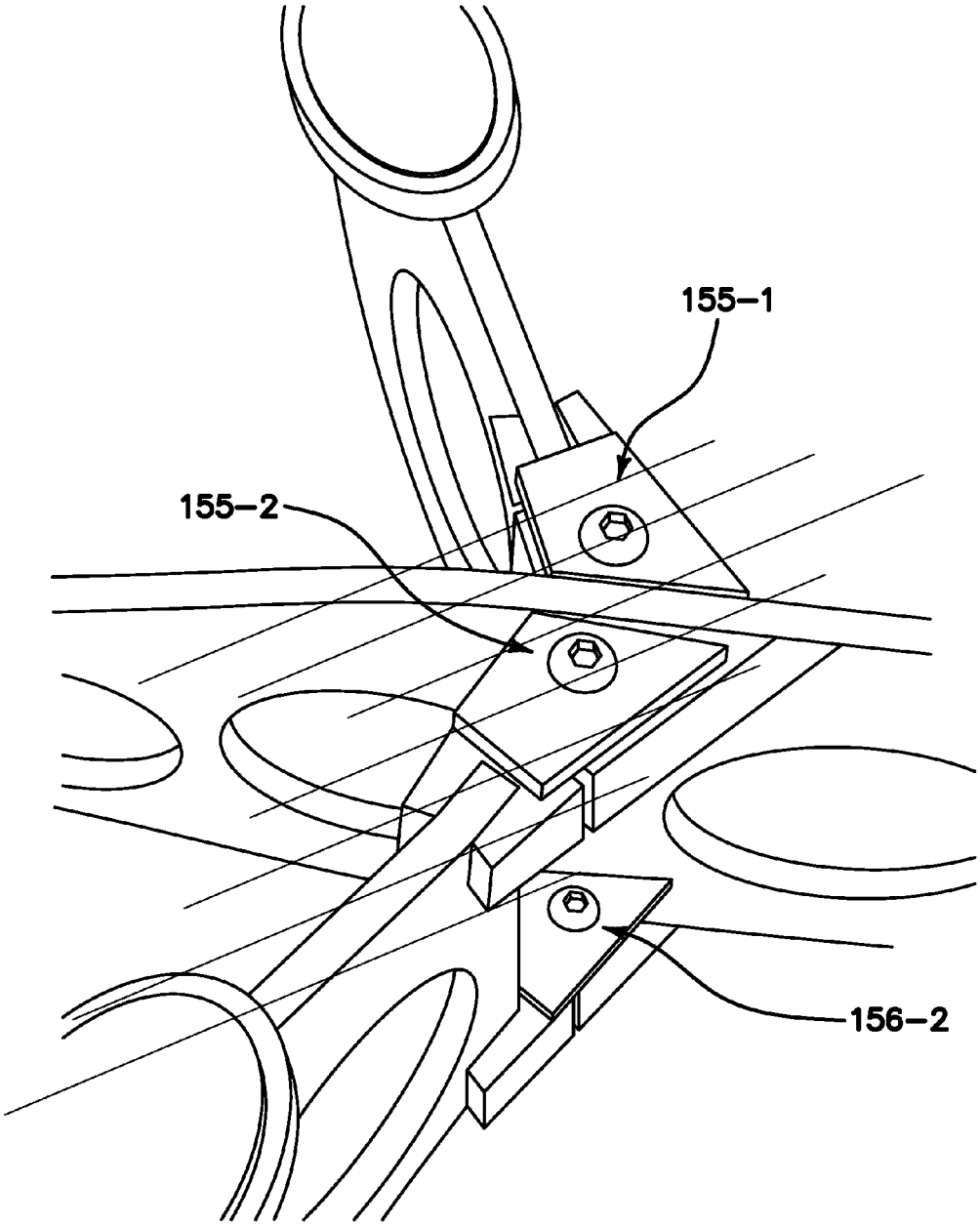

FIGS. 8A-8B illustrate side and top views, respectively, of an expandable arm 150 according to the embodiments of the present invention. With this embodiment, like arms 130-2 through 130-5, the expandable arm 150 includes upper connector 151, lower connector 152, first shelf 153 and second shelf 154. In addition, the expandable arm 150 includes upper linkage members 155-1, 155-2 and lower linkage members 156-1, 156-2 positioned along the length of the expandable arm 150. The upper linkage members 155-1, 155-2 and lower linkage members 156-1, 156-2 are configured to receive arm branches 160. As shown in FIGS. 9A-9B, the arm branches 160-1, 160-2 are generally configured in a manner consistent with the arms 130-1 through 130-5. Thus, in one embodiment, the arm branches 160-1 and 160-2 include an upper connector 161, lower connector 162 and shelf 163. In this instance, the connectors 161-1, 161-2, 162-1 and 162-2 serve to allow connection of the arm branches 160-1 and 160-2 to the first and second linkage 155, 156 of the expandable arm 150.

Figure 10A:
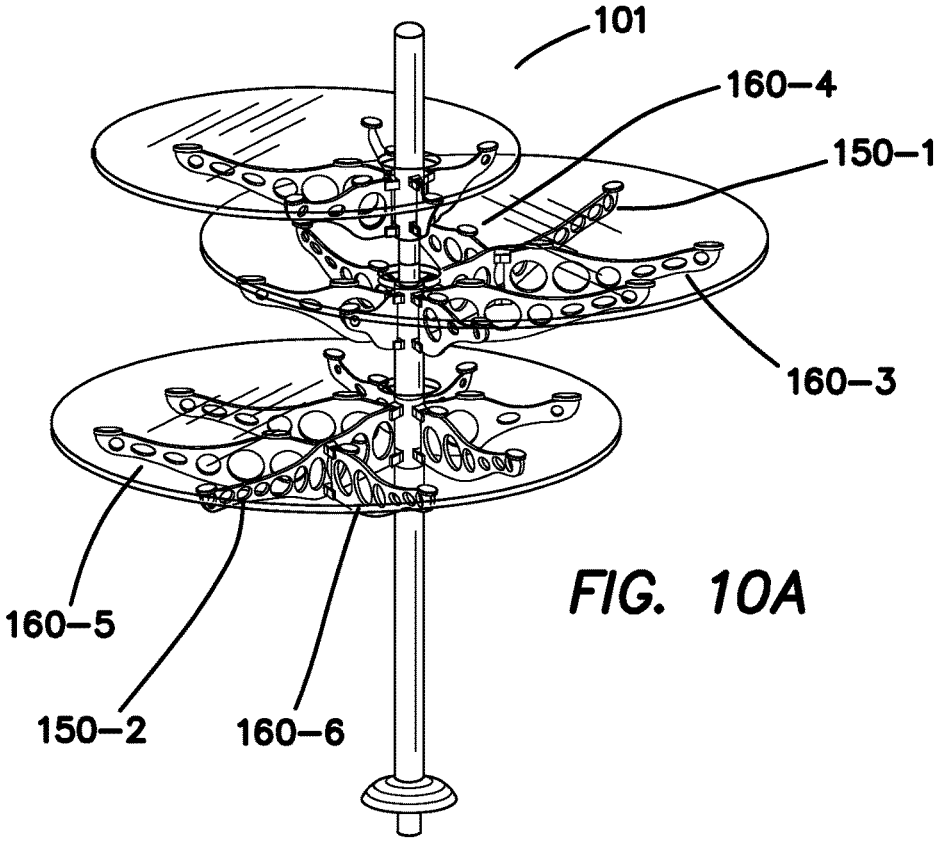
FIGS. 10A-10B illustrate upper perspective and side views of a standalone display table including a pair of expandable arms according to the embodiments of the present invention.
Figure 10B:
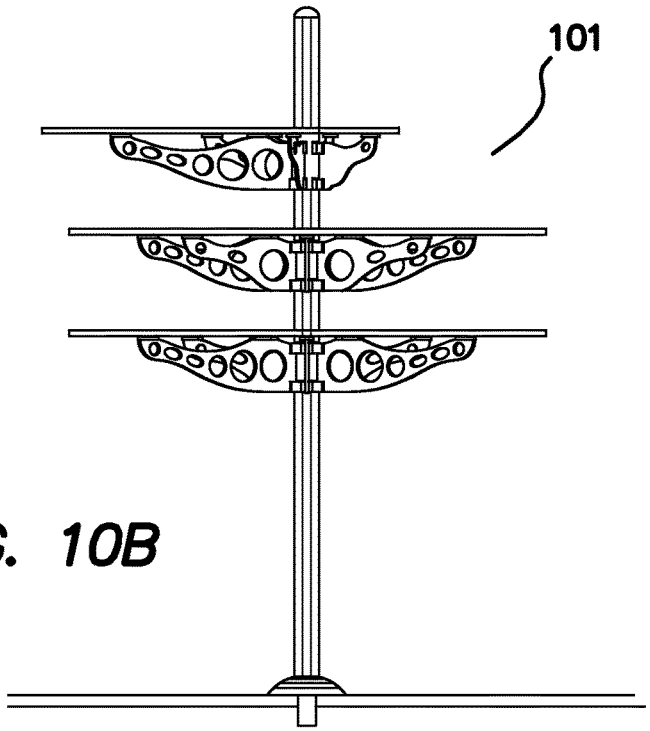

FIGS. 10A and 10B illustrate upper perspective and front views of a display table 101 including a first expandable arm 150-1 with a pair of arm branches 160-3 and 160-4 and a second expandable arm 150-2 including a pair of arm branches 160-5 and 160-6.

Figure 11A:
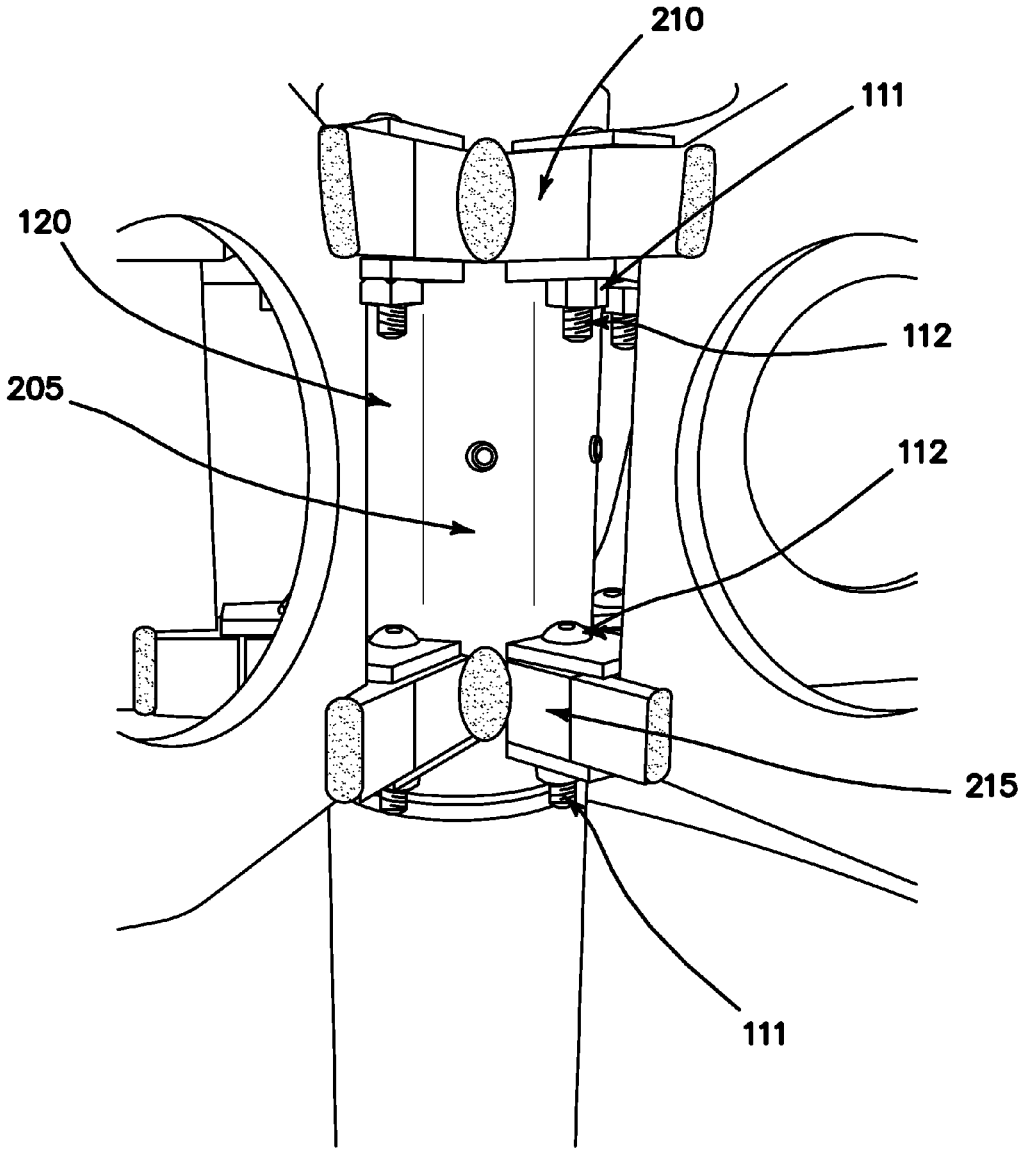
FIGS. 11A-11C illustrate side and top perspective views of an arm hub according to the embodiments of the present invention.
Figure 11B:
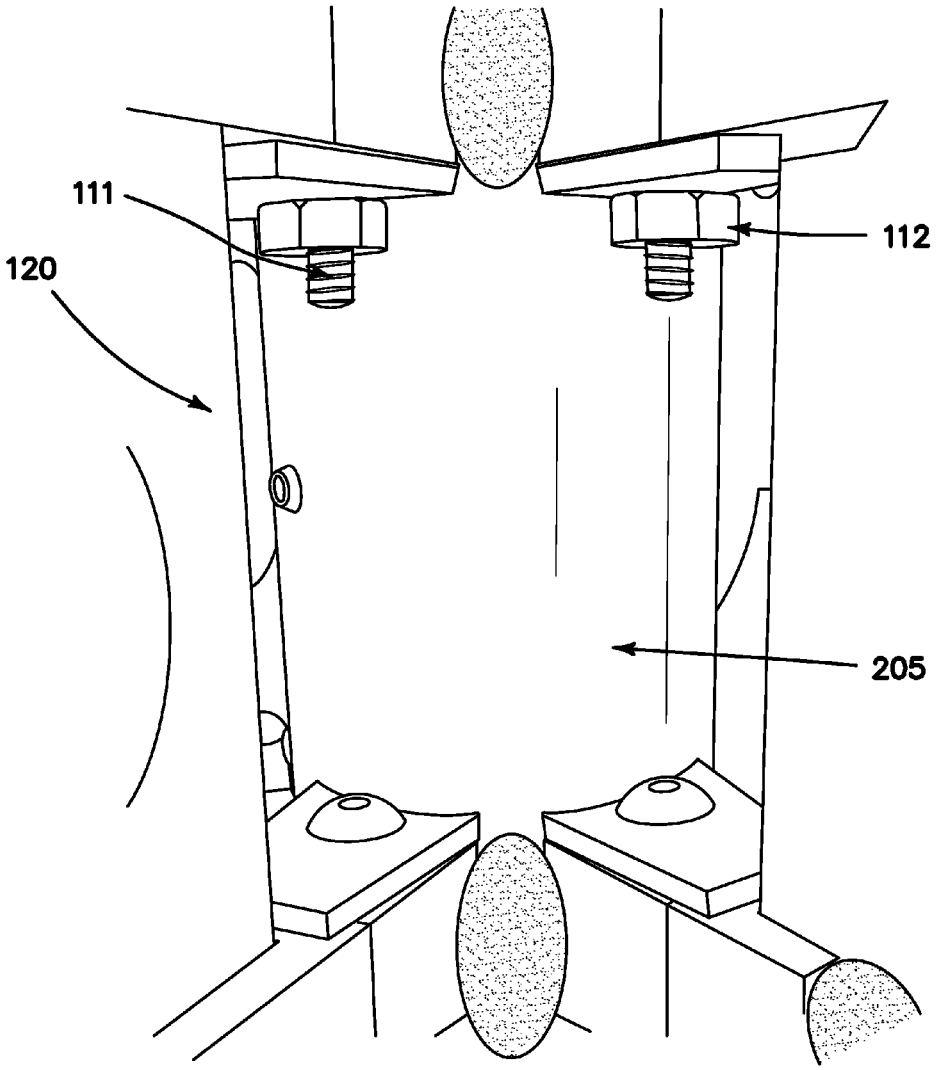
Figure 11C:
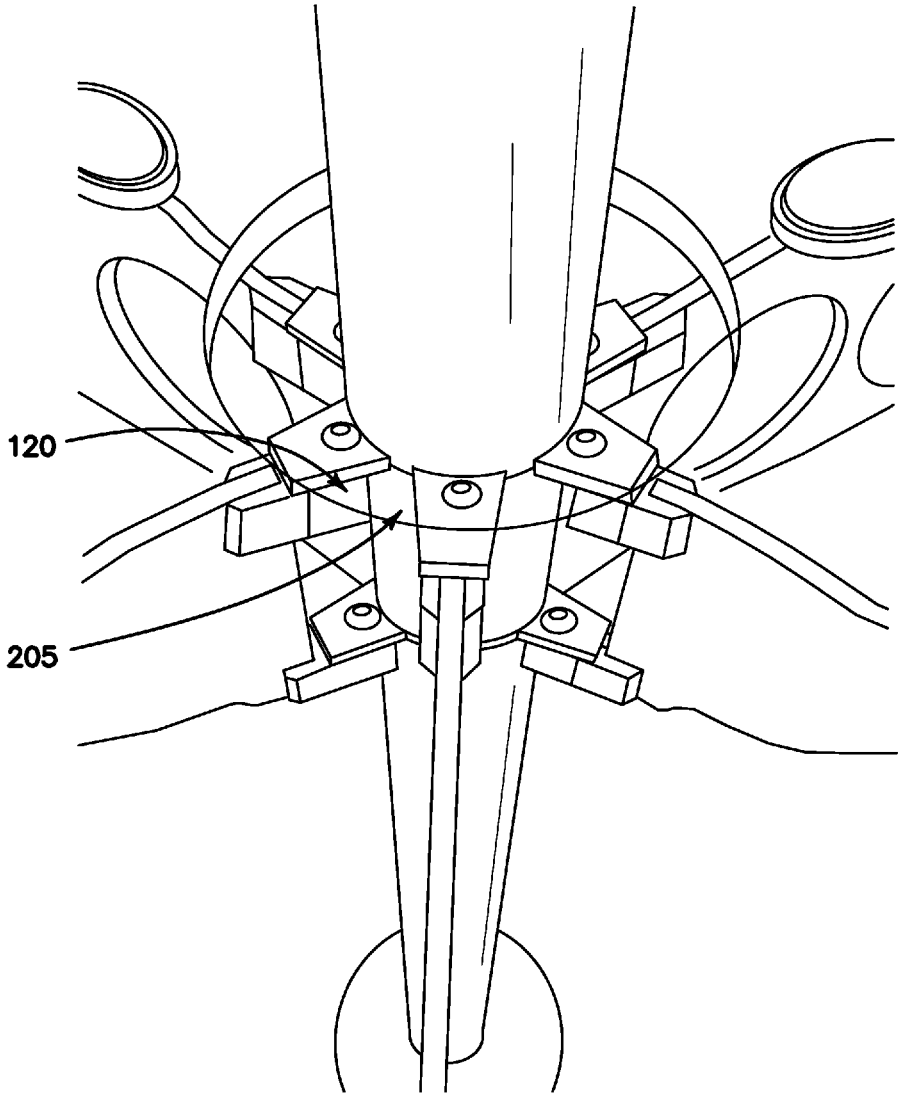

FIGS. 11A-11C show arm hub 120. Arm hub 120 includes a cylindrical body 205, upper connectors 210 and lower connectors 215. The upper connectors 210 and lower connectors 215 of the arm hub 200 are configured to mate with the upper and lower connectors of the arms 130, 150 allowing the arms 130, 150 to be connected to the arm hub 120. In one embodiment, the arm hub 120 includes three to five pairs of upper connectors 210 and lower connectors 215 to accommodate an equal number of arms. In other embodiments, more or less pairs of upper connectors 210 and lower connectors 215 may be included on said arm hub 120.

The support pole 110, best shown in FIGS. 1B and 10B, comprises a central rod 111 which extends from a connection node 175 upwards to a desired height and sleeves 112. While a connection node 175 may retain the central rod 111 in other embodiments, the central rod 111 may be retained by a weighted floor member or other device. A series of table sleeves 112-1 through 112-3 fit over the central rod 111 to form the support pole. A bottom table sleeve 112-1 rests upon a floor cap 113. Arm hub 120-1 rests on table sleeve 112-1 and arm hub 120-2 rests on table sleeve 112-2 and arm hub 120-3 rests on table sleeve 112-3. In such a configuration, the sleeves 112-1 through 112-3 and arm hubs 120-1 through 120-3 may each rotate relative to the central rod 111 and each other. Alternatively, the sleeves 112-1 through 112-3 and/or arm hubs 120-1 through 120-3 may be secured to the central rod 111 and/or each another. An optional end cap or decorative article 176 may be positioned at a top of the central rod 111. Other support pole configurations are possible without departing from the spirit and scope of the present invention.

Figure 12A:
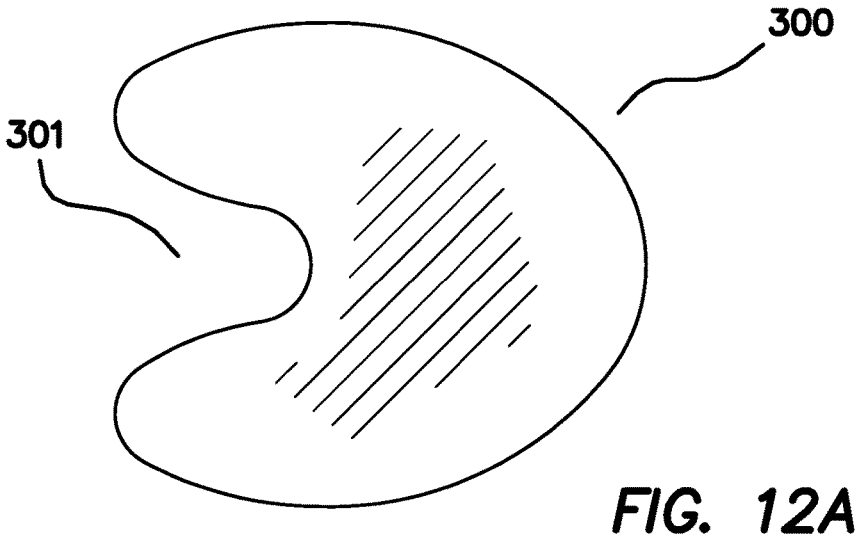
FIGS. 12A-12D illustrate top views of exemplary table tops according to the embodiments of the present invention.
Figure 12B:
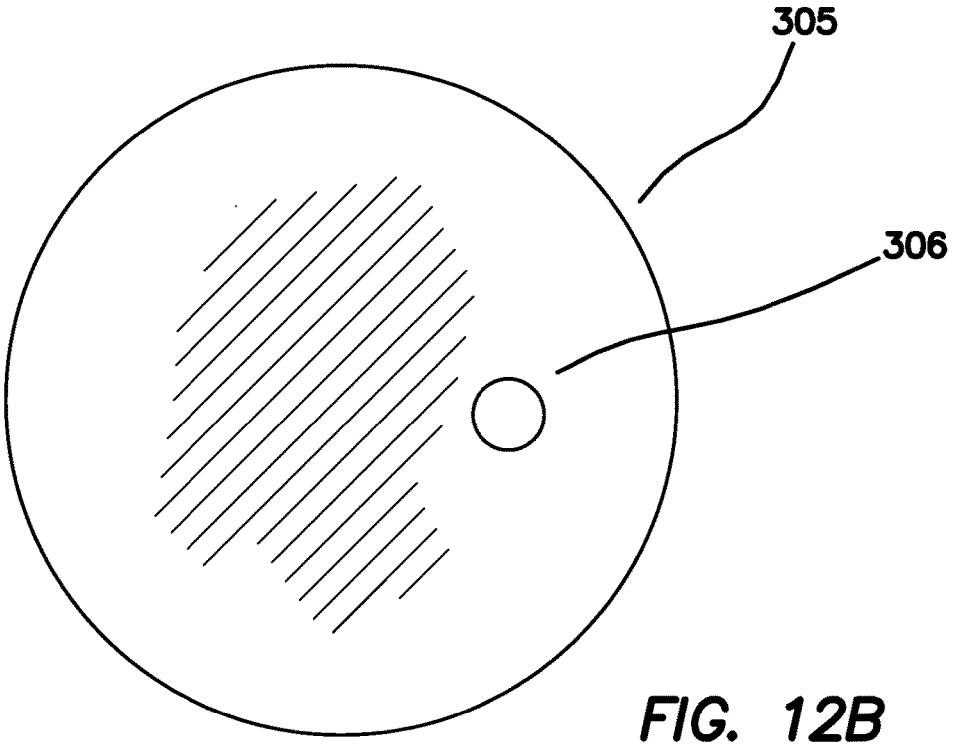
Figure 12C:
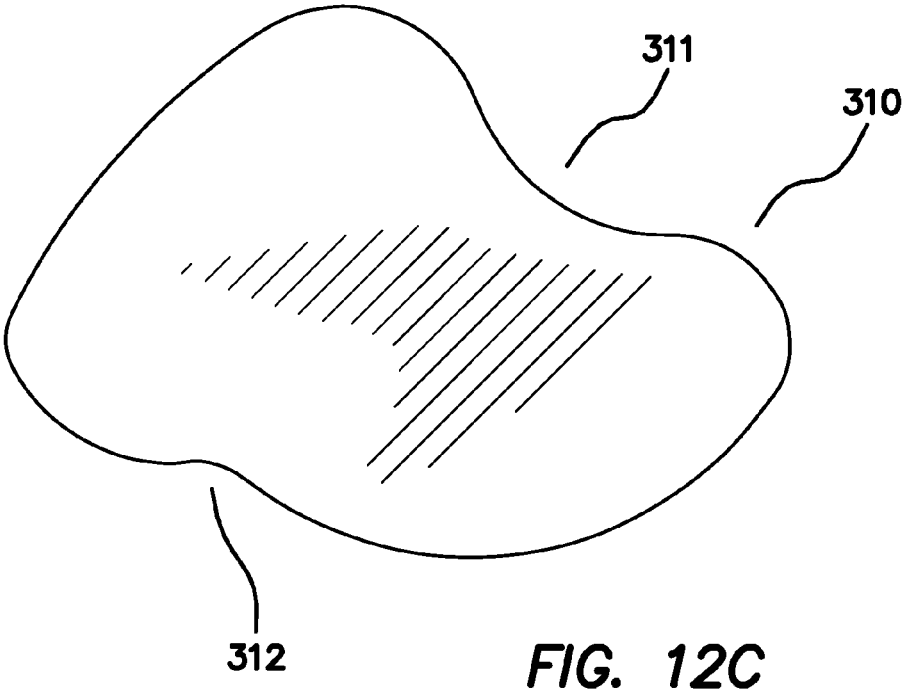
Figure 12D:
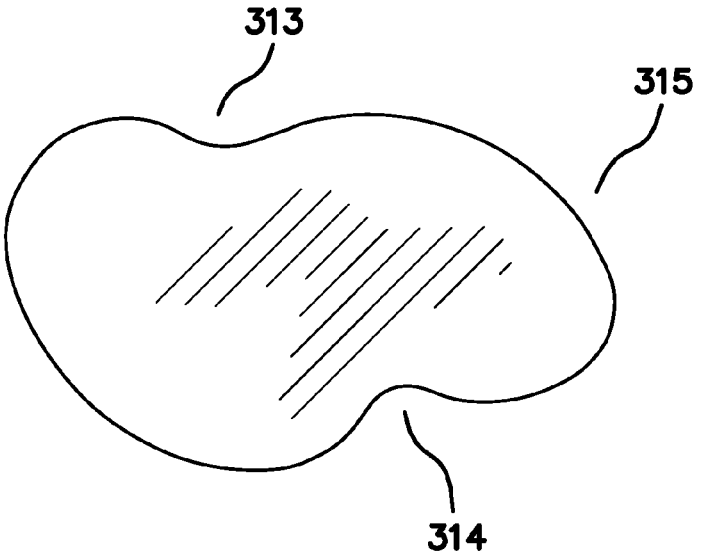

FIGS. 12A-12D illustrate top views of exemplary table tops according to the embodiments of the present invention. FIG. 12A shows a first table top 300 generally heart shaped defining open area 301 to accommodate the support pole 110 when positioned on the arms 130, 150. FIG. 12B shows a second table top 305 having a circular shape and opening 306 to receive the support pole 110 when positioned on the arms 130, 150. FIGS. 12C and 12D show third table top 310 and fourth table top 315, respectively. Each of the third table top 310 and fourth table top 315 has a polynomial shape defining multiple open areas 311-314 to accommodate the support pole 110 when positioned on the arms 130, 150. In one embodiment, the table tops are fabricated of transparent glass and include beveled edges. Other table top materials and shapes are possible without departing from the spirit and scope of the present invention.

While FIGS. 12A-12D show separate table tops, in another embodiment, the table tops and arms 130, 150 are a single, integral unit.

Figure 2B:
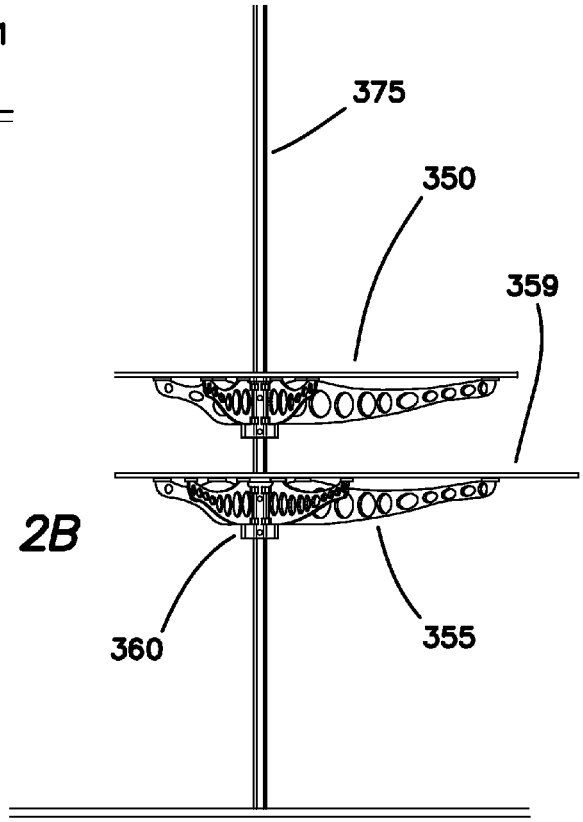
FIGS. 2A-2B illustrate upper perspective and front views of a wall-mounted display table according to the embodiments of the present invention.
Figure 2A:
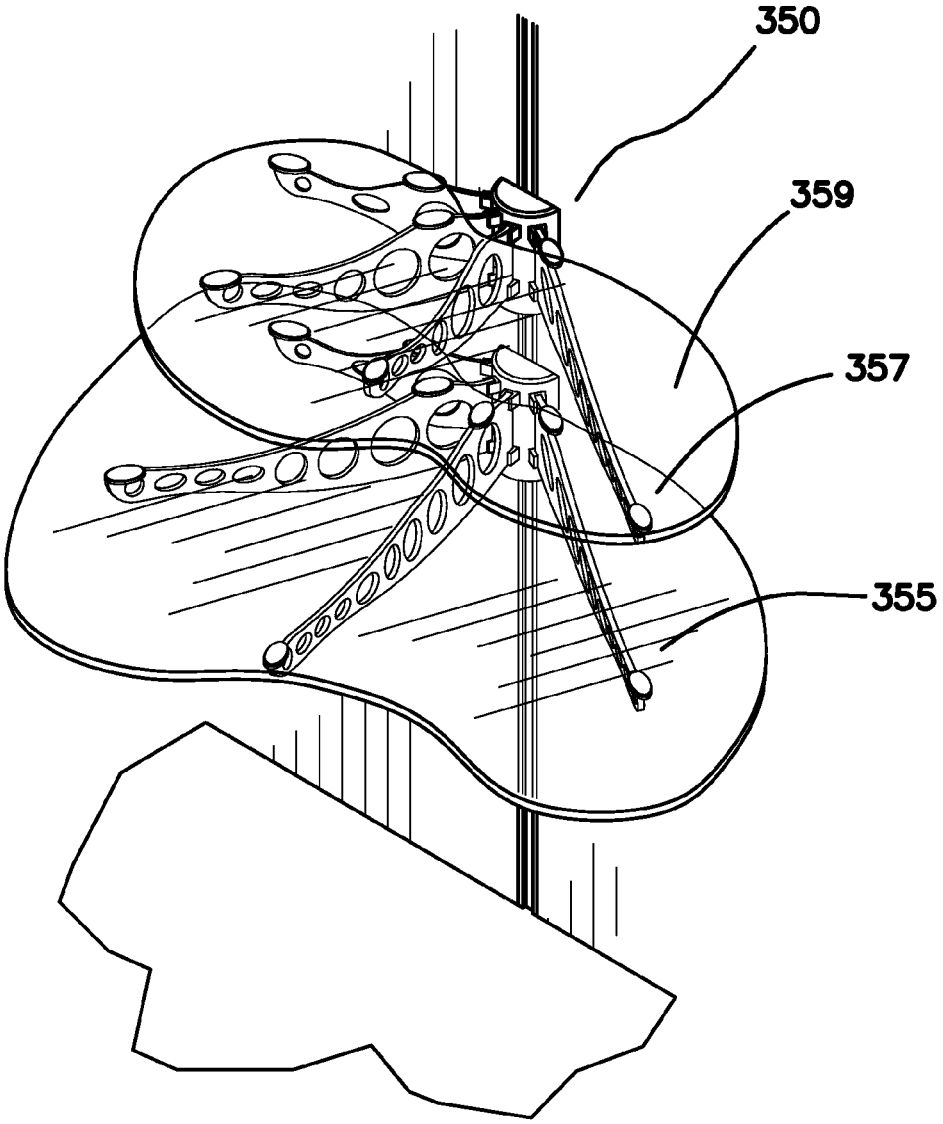
Figure 13A:
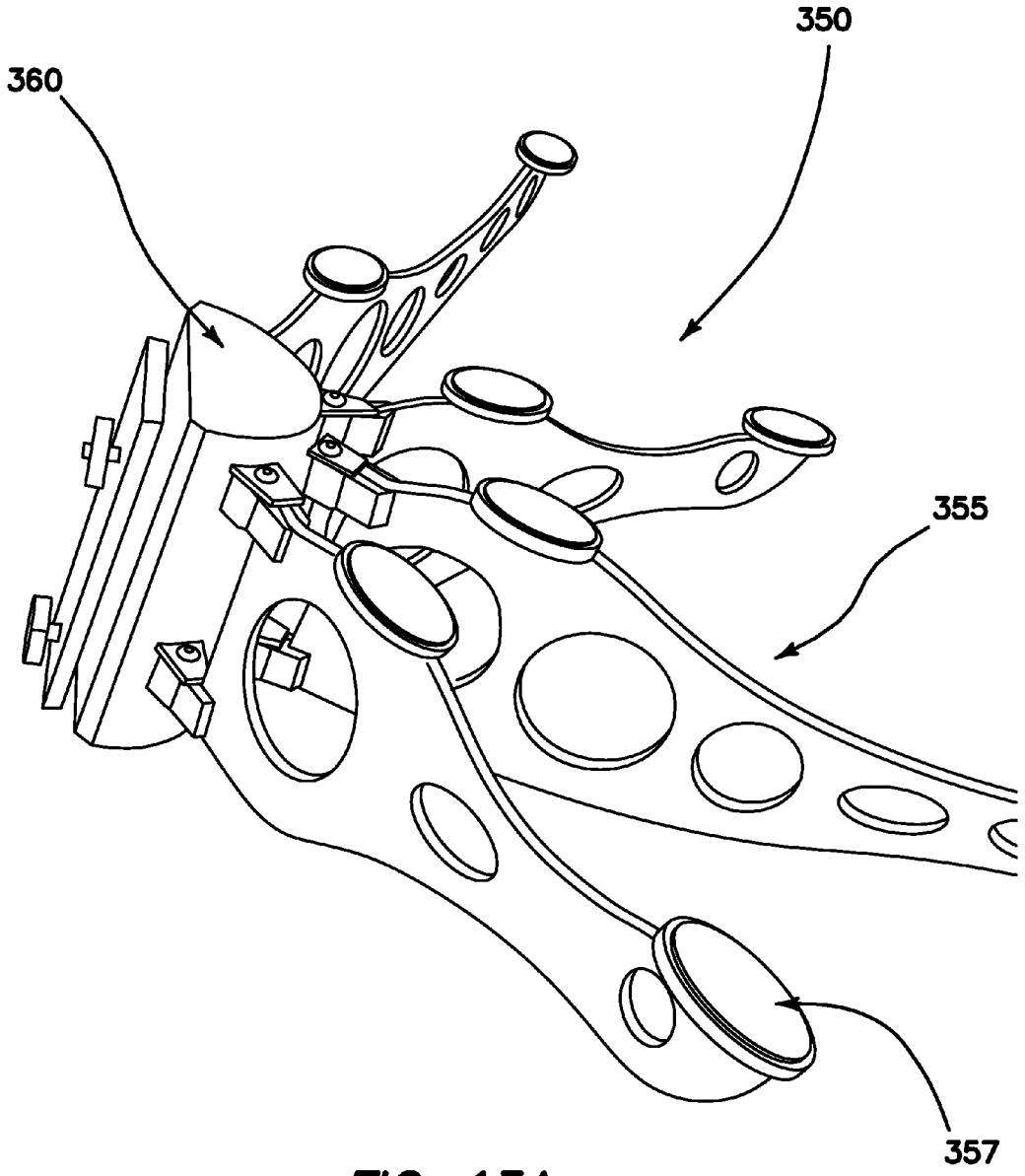
FIGS. 13A-13B illustrate perspective side, rear top and side views of a wall-mountable display table according to the embodiments of the present invention.
Figure 13B:
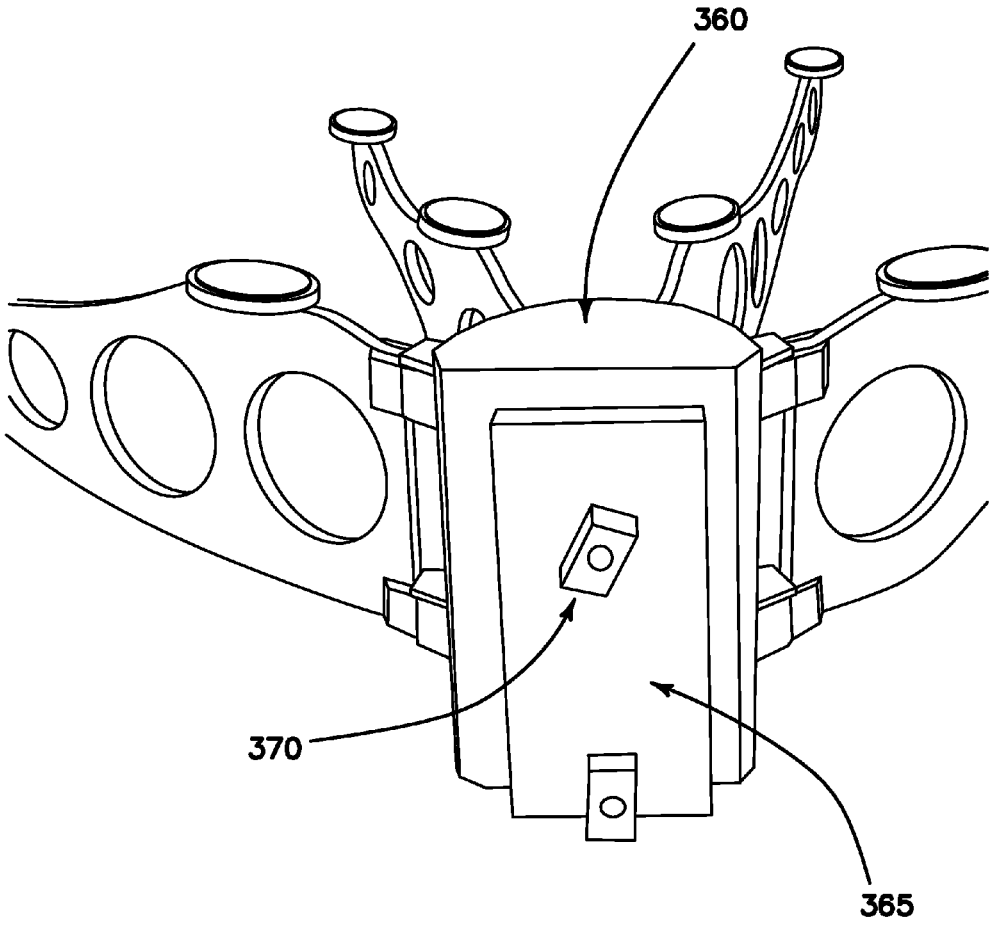
Figure 14:
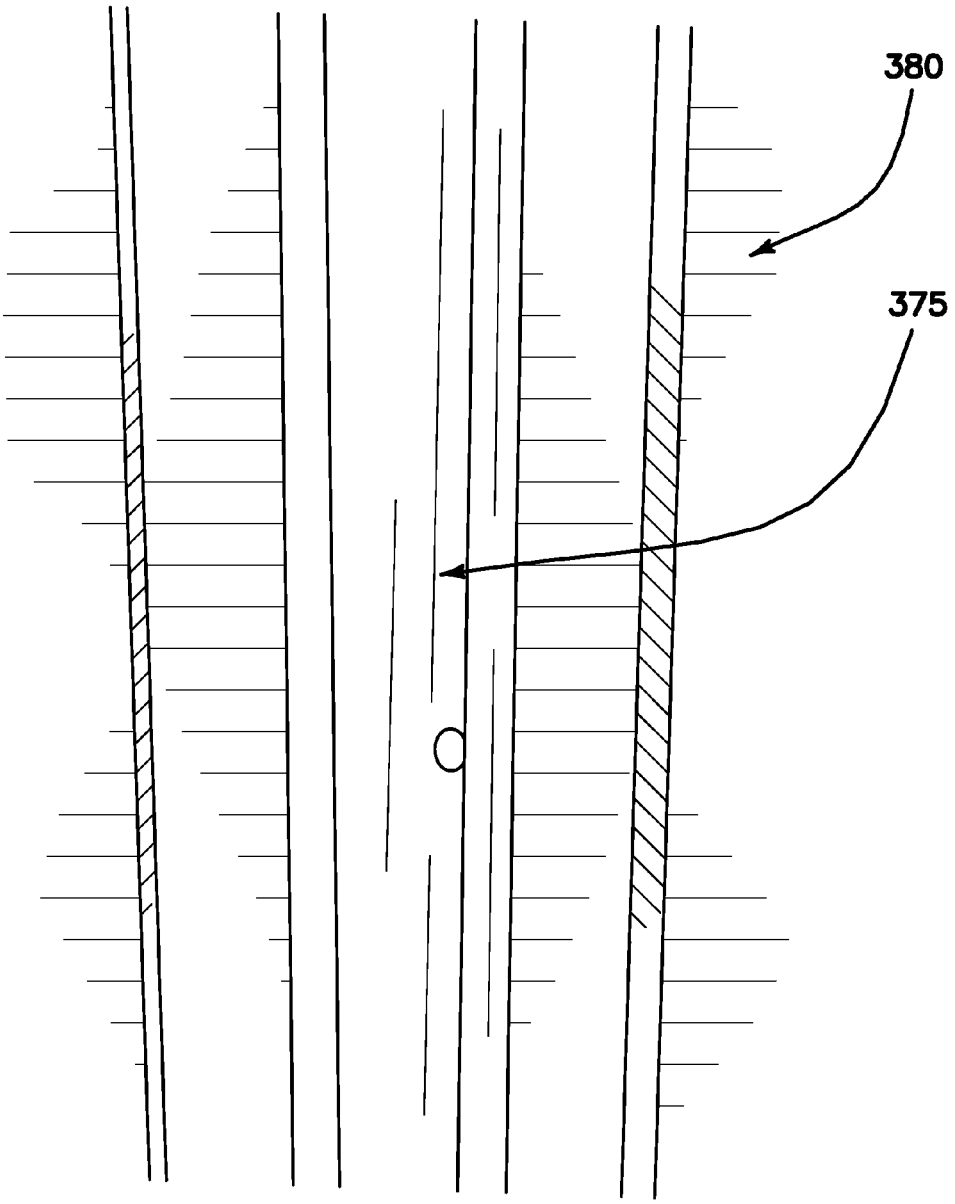
FIG. 14 illustrates a front view of a unistrut of the type suitable for attachment of the wall-mountable display table shown in FIGS. 13A-13B according to the embodiments of the present invention.

FIGS. 2A-2B illustrate upper perspective and front views of a wall-mounted display table 350 according to the embodiments of the present invention. FIGS. 13A-13B illustrate perspective side, rear top and side views of a wall-mountable display table 350 according to the embodiments of the present invention. The wall-mounted display table 350 includes one or more arms 355 extending from an arm hub 360. The arms 355 may include shelves 357 configured and positioned to support table tops 359. A support plate 365 connected to a rear of said arm hub 360 and a pair of adjustable connectors 370 allow the wall-mountable display table 350 to be connected to a unistrut 375 (FIG. 14) installed in a wall 380.

Figure 15:
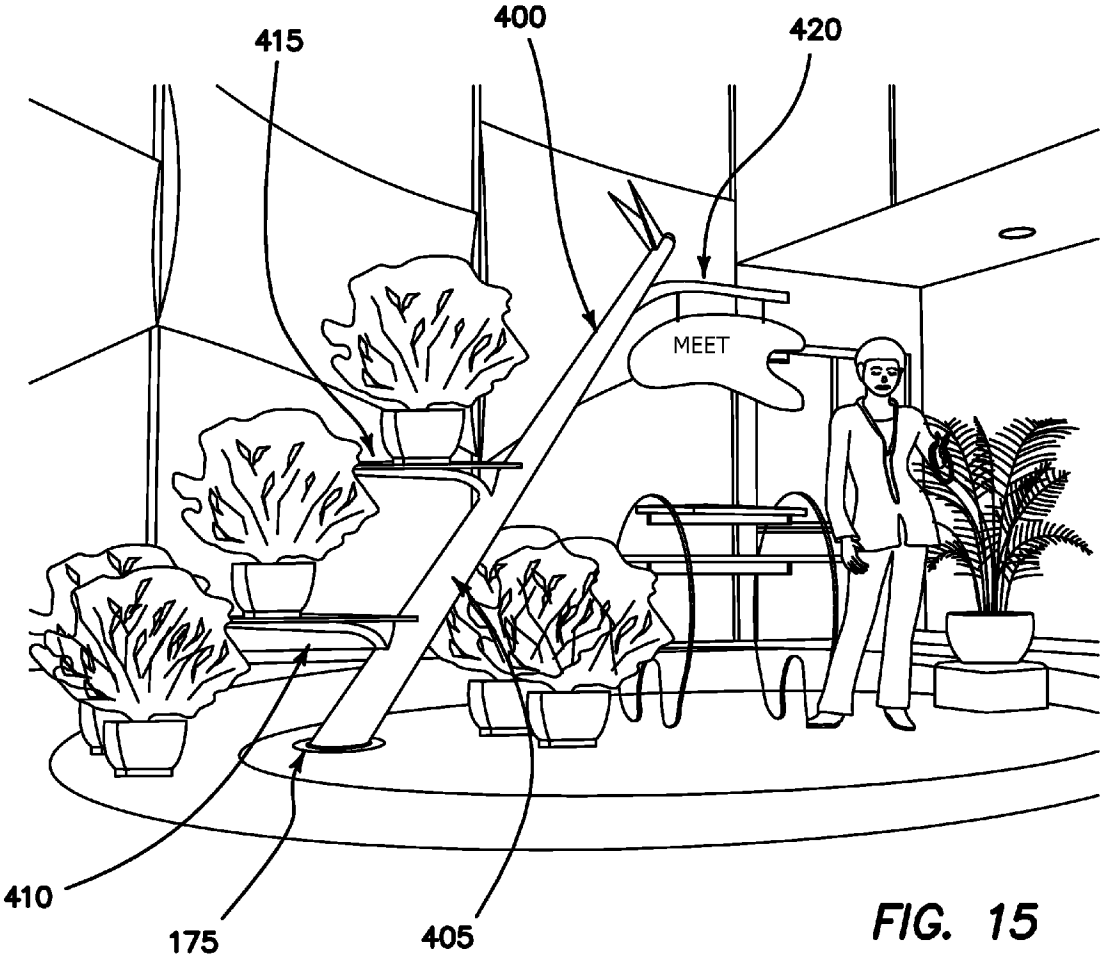
FIG. 15 illustrates a first alternative standalone display tables according to the embodiments of the present invention.

FIG. 15 shows an alternative display table 400 formed of a single member including a central support 405, one or more table top supports 410, table tops 415 and an optional signage support 420. The display table 400 is secured to a connection node 175. Alternatively, a weighted floor member may retain one end of the central support 405.

Figure 16A:
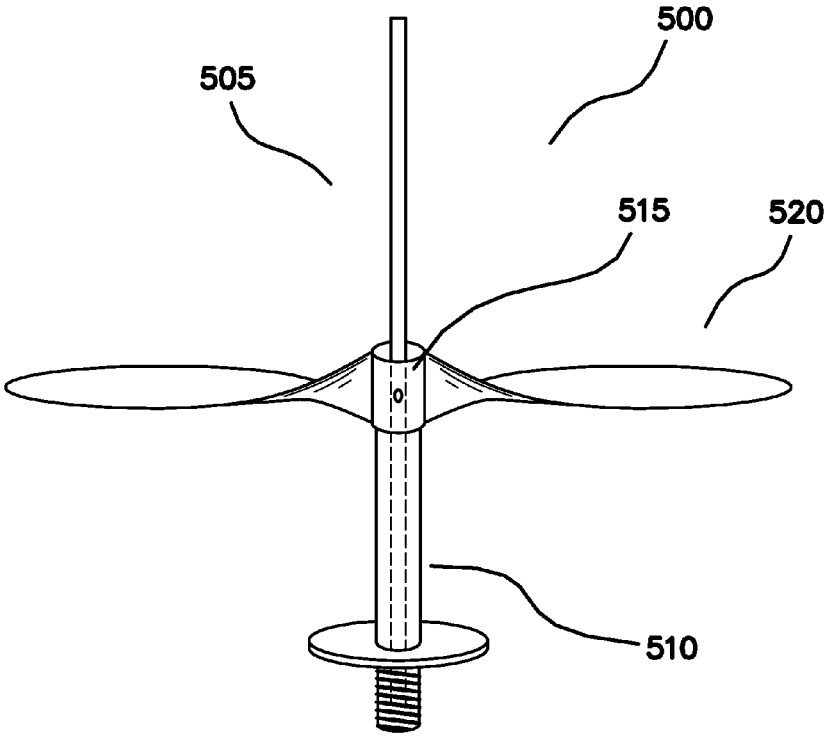
FIGS. 16A-16B illustrate a second alternative standalone display table according to the embodiments of the present invention.
Figure 16B:
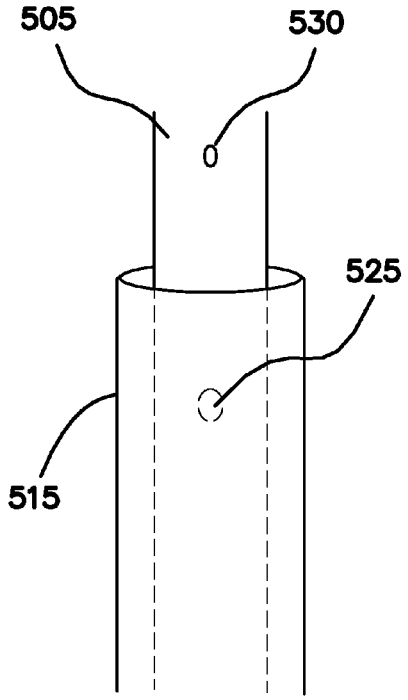

FIGS. 16A-16B show an alternative display table 500 comprising a support pole 505, one or more sleeves 510, arm hub 515 and integrated table tops 520 in the ornamental form of propellers. As shown in FIG. 16B, the arm hub 515 is secured to the support pole 505 with screws 525 or similar fasteners which mate with cavities or openings 530 in the support pole 505.

Figure 17:
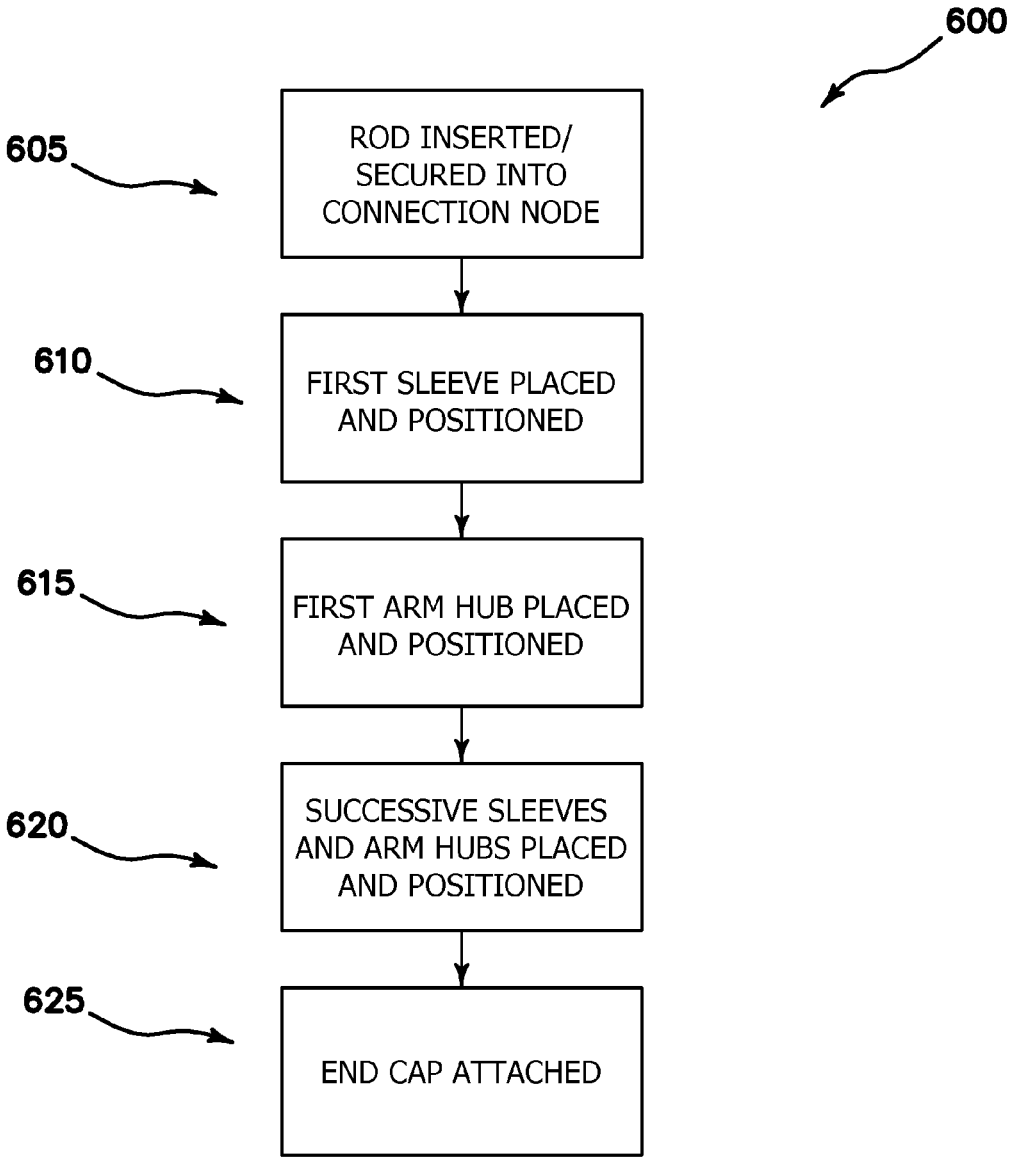
FIG. 17 illustrates a flow chart detailing one methodology for erecting a display table according to the embodiments of the present invention.

FIG. 17 shows a flow chart 600 detailing one methodology for erecting a display table according to the embodiments of the present invention. At 605, a rod is inserted/secured into a connection node (a floor cap may be optionally in place) in a floor as described in co-pending application Ser. No. 13/304,076. At 610, a first sleeve is placed over said rod and positioned near a bottom of said rod. Optionally, the sleeve is connected to the rod or floor cap. If a floor cap is in place, the sleeve rests thereupon. If no floor cap is in place, the sleeve may rest directly on the floor. At 615, a first arm hub having one or more arms is placed over said rod and positioned on said first sleeve. Optionally, the first arm hub in connected to the rod or first sleeve. At 620, one or more successive sleeves and arm hubs are placed over said rod in an alternating fashion until said rod is substantially concealed thereby. Optionally, the sleeves and/or arm hubs are connected to the rod or each other. At 625, an optional end cap or decorative article may be attached to a top of the rod.

Although the invention has been described in detail with reference to several embodiments, additional variations and modifications exist within the scope and spirit of the invention as described and defined in the following claims.

I claim:

1. A display table comprising:

a vertically oriented rod;

two or more arm hubs positioned about said rod, said two or more arm hubs tubular in form and dimensioned to slide over and rotate about said rod;

multiple arms extending substantially horizontally from each of said two or more arm hubs;

one or more sleeves positioned about said rod, each of said sleeves supporting one of said two or more arm hubs about said rod with at least one sleeve positioned between a lower arm hub and an upper arm hub whereby said at least one sleeve sits atop said lower arm hub and supports said upper arm hub, said sleeves tubular in form and dimensioned to slide over said rod for separating vertically said two or more arm hubs, wherein said at least one sleeve is configured to rotate relative to said rod when said at least one sleeve supports said upper arm hub; and a table top supported by said multiple arms extending substantially horizontally from each of said two or more arm hubs, said table top including an opening receiving passage of said vertically oriented rod or an open area for accommodating passage of said vertically oriented rod, said open area at least partially surrounding said vertically oriented rod.

2. The display table of claim 1 wherein one end of said rod is configured to be received by a connection node in a floor.

3. The display table of claim 1 wherein said one or more arms include one or more shelves for supporting one or more table tops, at least one shelf of said one or more shelves on each of said one or more arms proximate an end of said one or more arms.

4. The display table of claim 1 wherein one or more of said one or more arms includes one or more branches extending therefrom.

5. A display table comprising:

a rod;

two or more arm hubs positioned about said rod, said two or more arm hubs tubular in form and dimensioned to slide over and rotate about said rod;

one or more sleeves positioned about said rod, said one or more sleeves supporting said two or more arm hubs with at least one sleeve positioned between a lower arm hub and upper arm hub whereby said at least one sleeve sits atop said lower arm hub and supports said upper arm hub, said sleeves tubular in form and dimensioned to slide over said rod for separating vertically said two or more arm hubs, wherein said at least one sleeve is configured to rotate relative to said rod when said at least one sleeve supports said upper arm hub;

one or more arms extending substantially horizontally from said two or more arm hubs; and a table top supported by multiple arms extending substantially horizontally from each of said two or more arm hubs, said table top including an opening receiving passage of said rod or an open area for accommodating passage of said rod, said open area at least partially surrounding said rod.

6. The display table of claim 5 wherein one end of said rod is configured to be received by a connection node in a floor.

7. The display table of claim 5 wherein said one or more arms include one or more shelves for supporting said one or more table tops.

8. The display table of claim 5, wherein one or more of said one or more arms includes one or more branches extending therefrom.

* * * * *